US005539363A

United States Patent [19]

Maruyama et al.

[11] Patent Number: 5,539,363

[45] Date of Patent: Jul. 23, 1996

[54] DIELECTRIC RESONATOR APPARATUS HAVING ADJUSTABLE EXTERNAL STRUCTURE AND METHOD OF ADJUSTING SAME

[75] Inventors: Takashi Maruyama; Hideyuki Kato; Yukihiro Kitaichi, all of Nagaokakyo, Japan

[73] Assignee: Murata Manufacturing Co., Ltd., Japan

[21] Appl. No.: 357,945

[22] Filed: Dec. 15, 1994

[30] Foreign Application Priority Data

Dec. 16, 1993 [JP] Japan ..... 5-316768

[51] Int. Cl.[6] ..... H01P 1/205

[52] U.S. Cl. ..... 333/206; 333/222

[58] Field of Search ..... 333/219.1, 224, 333/222, 206, 202, 207, 223, 219

[56] References Cited

U.S. PATENT DOCUMENTS 5,345,202 9/1994 Kobayashi et al. ..... 333/206

5,379,012 1/1995 Shimizu et al. ..... 333/206

*Primary Examiner*—Benny Lee

*Assistant Examiner*—David H. Vu

*Attorney, Agent, or Firm*—Majestic, Parsons, Siebert & Hsue

[57] ABSTRACT

A dielectric resonator apparatus contains coaxial resonators in a dielectric block made of a dielectric material, having a first end surface, a second end surface and a plurality of side surfaces therebetween. The block is formed with resonator-forming throughholes penetrating therethrough and having openings on the first and second end surfaces. Inner conductors are formed inside these resonator-forming throughholes, and an outer conductor is formed at least on the side surfaces and the first end surface. A molded resin member made of a dielectric resin material, having pin-accepting holes therethrough, is attached to the resonator-forming throughholes. Input/output terminals are formed on the molded resin member so as to be insulated from the inner and outer conductors. Metallic pins are inserted into the pin-accepting holes to thereby contact the input-output terminals and to provide external-connection capacitance with the inner conductors. A conductive film is formed at least on the second end surface or the molded resin member for preventing electromagnetic waves from leaking outside. Functional characteristics of such an apparatus can be adjusted by controlling the external-connection capacitance by varying the distance by which the metallic pins are inserted into the pin-accepting holes.

5 Claims, 6 Drawing Sheets

DIELECTRIC RESONATOR APPARATUS HAVING ADJUSTABLE EXTERNAL STRUCTURE AND METHOD OF ADJUSTING SAME

BACKGROUND OF THE INVENTION

This invention relates to dielectric resonator apparatus and methods of adjusting their characteristics. More particularly, this invention relates to dielectric resonator apparatus having one or more coaxial dielectric resonators and methods of adjusting characteristics of such apparatus.

Prior art technology in the field of dielectric resonator apparatus will be described first with reference to FIGS. 10 and 11 showing a conventional dielectric resonator adapted to function as a three-stage bandpass filter, comprising an approximately parallelopipedic block 100 made of a dielectric material, molded resin members 110 made of a resin material, metallic pins 120 and upper and lower metallic casing members 130 and 140 for magnetic shielding. The dielectric block 100 has three resonator-forming throughholes 102*a*, 102*b* and 102*c* therethrough and coupling throughholes 103*a* and 103*b* respectively between the resonator-forming throughholes 102*a* and 102*b* and between the throughholes 102*b* and 102*c*. These throughholes 102*a*, 102*b*, 102*c*, 103*a* and 103*b* penetrate the dielectric block 100 between its first end surface 101*a* and second end surface 101*b*, having openings thereon. An inner conductor 104 is formed on the inner surface of each of the resonator-forming throughholes 102*a*, 102*b* and 102*c*, with one end extending to one of the openings and the other end extending to the other of the openings. An outer conductor 105 is formed on the outer surfaces of the dielectric block 100 except the second end surface 101*b* such that the inner conductors 104 are each connected with the outer conductor 105 (at the shorted end parts) on the first end surface 101*a* but insulated from the outer conductor 105 (at the open end parts) on the second end surface 101*b*.

The molded resin members 110 of a dielectric resin material are each formed by molding with an input/output terminal 111 inserted by an insert-molding process and also with a pin-accepting hole 112 for having a metallic pin 120 inserted therein. These molded resin members 110 are inserted into the resonator-forming throughholes 102*a* and 102*c*, and the metallic pins 120 are inserted into their pin-accepting holes 112 so as to be in electrically conductive relationship with the input/output terminals 111 and to provide external coupling capacitance $C_e$ with the inner conductors 104. The lower metallic casing member 140 is provided with a plurality (five, as shown in FIG. 11) of tab terminals 141 for grounding and fastening pieces 142 for fastening the dielectric block 100 therein. The tab terminals 141 are adapted to be soldered onto a grounding terminal of a circuit board (not shown) with a desired circuitry formed thereon. The upper and lower metallic casing members 130 and 140 are also provided with holes 133 and protrusions 143, respectively, such that they can be engaged together. Although the second end surface 101*b* of the dielectric block 100 is not covered with the outer conductor 105, electromagnetic waves are prevented from leaking outside therefrom because it is shielded by the mutually engaged upper and lower metallic casing members 130 and 140 as shown in FIG. 10.

The three coaxial dielectric resonators thus formed inside the single dielectric block 100 are magnetically coupled through the coupling throughholes 103*a* and 103*b*. The degree of coupling between the coaxial dielectric resonators can be adjusted by varying conditions such as the diameters, lengths and the positions of the coupling throughholes 103*a* and 103*b*. The coaxial dielectric resonators formed in the resonator-forming throughholes 102*a* and 102*c* are also connected individually with the input/output terminals 111 through the external coupling capacitance $C_e$ and the metallic pins 120. The dielectric resonator apparatus thus formed can function as a three-stage bandpass filter. The level of each external coupling capacitance $C_e$ can be adjusted by varying the distance by which the metallic pins 120 are inserted into the pin-accepting holes 112.

Dielectric resonator apparatus as shown in FIGS. 10 and 11 are not compact because the upper and lower metallic casing members 130 and 140 must be provided and the tab terminals 141 protrude from them, and the number of parts is also large. In other words, such a dielectric resonator apparatus is not suited for surface-mounting and has the disadvantage of being costly.

In view of such problems as discussed above, there has also been proposed another kind of dielectric resonator apparatus as shown in FIGS. 12 and 13. The exemplary apparatus shown in FIGS. 12 and 13 is designed to function as a two-stage bandpass filter, comprising a block 201 of an approximately rectangular parallelopiped made of a dielectric material, having two resonator-forming throughholes 202*a* and 202*b* which penetrate the dielectric block 201 between its first end surface 201*a* and second end surface 201*b*, having openings thereon. An inner conductor 204 is formed on the inner surface of each of the resonator-forming throughholes 202*a* and 202*b*, with one end extending to one of the openings (on the first end surface 201*a*) and the other end extending towards but not reaching the other of the openings (on the second end surface 201*b*). An outer conductor 205 is formed on the outer surfaces of the dielectric block 201 inclusive of the second end surface 201*b* such that the inner conductors 204 are each connected with the outer conductor 205 (at the shorted end parts) on the first end surface 201*a* but insulated from the outer conductor 205 (at the open end parts) on the second end surface 201*b*. In other words, each of the resonator-forming throughholes 202*a* and 202*b* has an insulating section 208 which separates the inner conductor 204 from the outer conductor 205 and at which there is no conductor present. On the outer peripheral surface of the dielectric block 201, there are input/output electrodes 206 and 207 formed, insulated from the outer conductor 205. The outer conductor 205 is adapted to be soldered onto a grounding terminal of a circuit board (not shown).

The two coaxial dielectric resonators thus formed inside the single dielectric block 201 are capacitively coupled across the two insulating sections 208. External coupling capacitance $C_e$ also appears between electrode 206 and one of the inner conductors 204 and between electrode 207 and the other inner conductor 204 such that the coaxial dielectric resonators are each connected to the input/output electrode 206 or 207 through the external coupling capacitance $C_e$. The dielectric resonator apparatus thus formed can function as a two-stage bandpass filter. The level of each external coupling capacitance $C_e$ can be adjusted by varying conditions such as the areas and positions of the input/output electrodes 206 and 207 and the diameters of the resonator-forming throughholes 202*a* and 202*b*.

With a dielectric resonator apparatus as explained above with reference to FIGS. 12 and 13, however, the areas and positions of the input/output electrodes 206 and 207 must be redesigned whenever an attempt is made to change the external coupling capacitance $C_e$ in order to adjust or change functional characteristics of the apparatus such as its frequency characteristics. This means that it takes a long time to design such a dielectric resonator apparatus properly.

SUMMARY OF THE INVENTION

It is therefore an object of this invention to eliminate the problems as stated above by providing compact, inexpensive dielectric resonator apparatus which can be surface-mounted easily and adjusted quickly.

It is another object of the invention to provide methods of adjusting functional characteristics of such dielectric resonator apparatus.

A dielectric resonator apparatus embodying the invention, with which the above and other objects can be accomplished, may be characterized as containing coaxial dielectric resonators and comprising: (i) a dielectric block made of a dielectric material, having a first end surface, a second end surface and a plurality of side surfaces therebetween and being formed with resonator-forming throughholes penetrating therethrough and having openings on its first and second end surfaces; (ii) inner conductors inside these resonator-forming throughholes; (iii) an outer conductor at least on the side surfaces and the first end surface of the dielectric block; (iv) a molded resin member made of a dielectric resin material, having pin-accepting holes therethrough and being attached to the resonator-forming throughholes; (v) input/output terminals formed on this molded resin member and insulated from the inner and outer conductors; (vi) metallic pins adapted to be inserted into the pin-accepting holes to thereby contact the input-output terminals and to provide external-connection capacitance with the inner conductors; and (vii) shielding means for preventing electromagnetic waves from leaking outside. The shielding means may be a conductive film formed, for example, on the second end surface or on outer surfaces of the molded resin member. Functional characteristics of such apparatus can be adjusted by controlling its external-connection capacitance by varying the distance by which the metallic pins are inserted into the pin-accepting holes.

DESCRIPTION OF THE DRAWINGS

The accompanying drawings, which are incorporated in and form a part of this specification, illustrate embodiments of the invention and, together with the description, serve to explain the principles of the invention. In the drawings.

Throughout herein, corresponding components of apparatus according to different embodiments of the invention are indicated by the same numerals, which may be followed by different letters such as 2A, 2B and 2C in order to serve as reminders that they represent different embodiments.

DETAILED DESCRIPTION OF THE INVENTION

Figure 1:
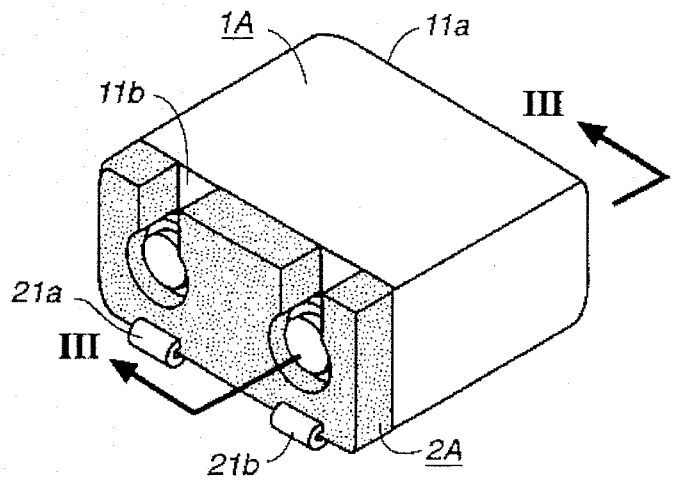
FIG. 1 is an external view of a dielectric resonator apparatus according to a first embodiment of the invention.
Figure 2:
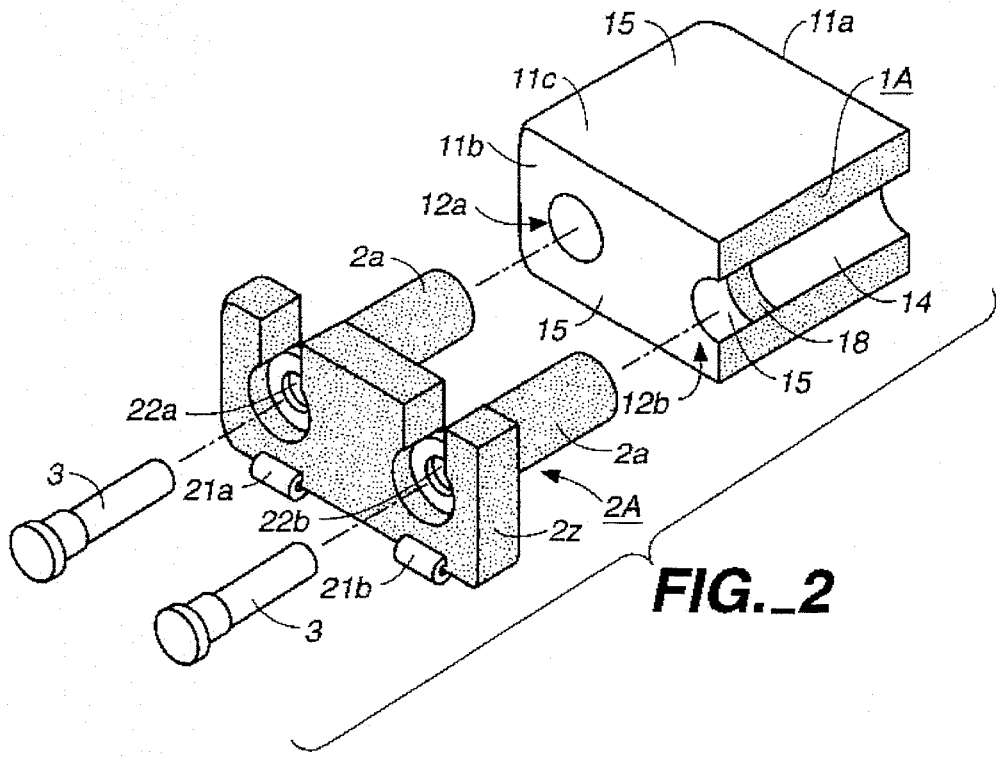
FIG. 2 is an exploded diagonal view of the apparatus of FIG. 1 with a portion of its dielectric block removed.
Figure 3:
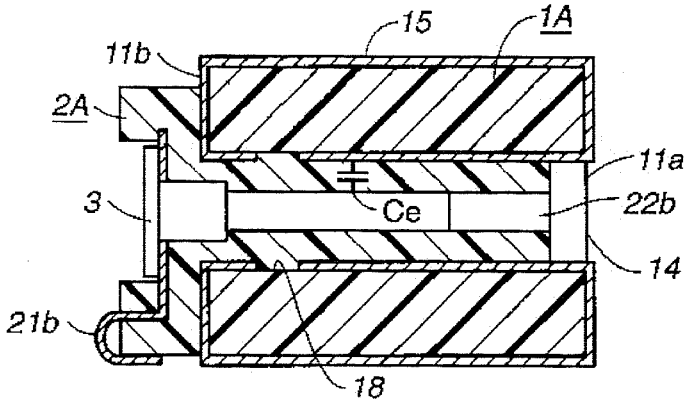
FIG. 3 is a sectional view of the apparatus of FIG. 1 taken along line III—III therein.

FIGS. 1, 2 and 3 show a dielectric resonator apparatus according to a first embodiment of the invention adapted to function as a two-stage bandpass filter, comprising a dielectric block 1A approximately of the shape of a rectangular parallelopiped made of a dielectric material such as a ceramic with dielectric constant (or relative permittivity) $\epsilon_r$ about equal to 90, a molded resin member 2A and two metallic pins 3. The dielectric block 1A is provided with two resonator-forming throughholes 12*a* and 12*b* with openings at a first end surface 11*a* and a second end surface 11*b* of the block 1A. An inner conductor 14 is formed on the inner peripheral surface of each of the resonator-forming throughholes 12*a* and 12*b*, with one end extending to one of the openings (on the first end surface 11*a*) and the other end extending towards but not reaching the other of the openings (on the second end surface 11*b*). An outer conductor 15 is formed on the first end surface 11*a* and a side surface 11*c* of the dielectric block 1A such that the inner conductors 14 are each connected with the outer conductor 15 (at the shorted end parts) on the first end surface 11*a*. The outer conductor 15 is formed on the second end surface 11*b* as a shielding means, and in particular as a first conductor film. At the other openings of the resonator-forming throughholes 12*a* and 12*b* on the second end surface 11*b*, the outer conductor 15 is formed with a gap of a certain width from the inner conductor 14. In other words, the inner conductors 14 are insulated from the outer conductor 15 at the other end, being retracted from the outer conductor 15 by a specified distance. Thus, the other end parts (open end parts) of the inner conductors 14 are insulated from the outer conductor 15 on the second end surface 11*b*. In other words, each of the resonator-forming throughholes 12*a* and 12*b* has an annular insulating section 18 which separates the inner conductor 14 from the outer conductor 15 and at which there is no conductor present.

Figure 10:
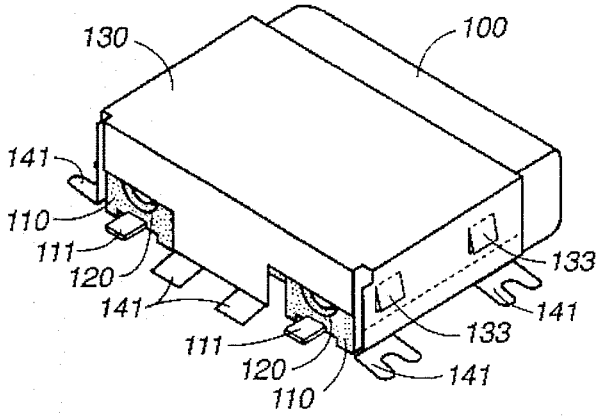
FIG. 10 (PRIOR ART)
FIG. 10 is an external view of a prior art dielectric resonator apparatus.
Figure 11:
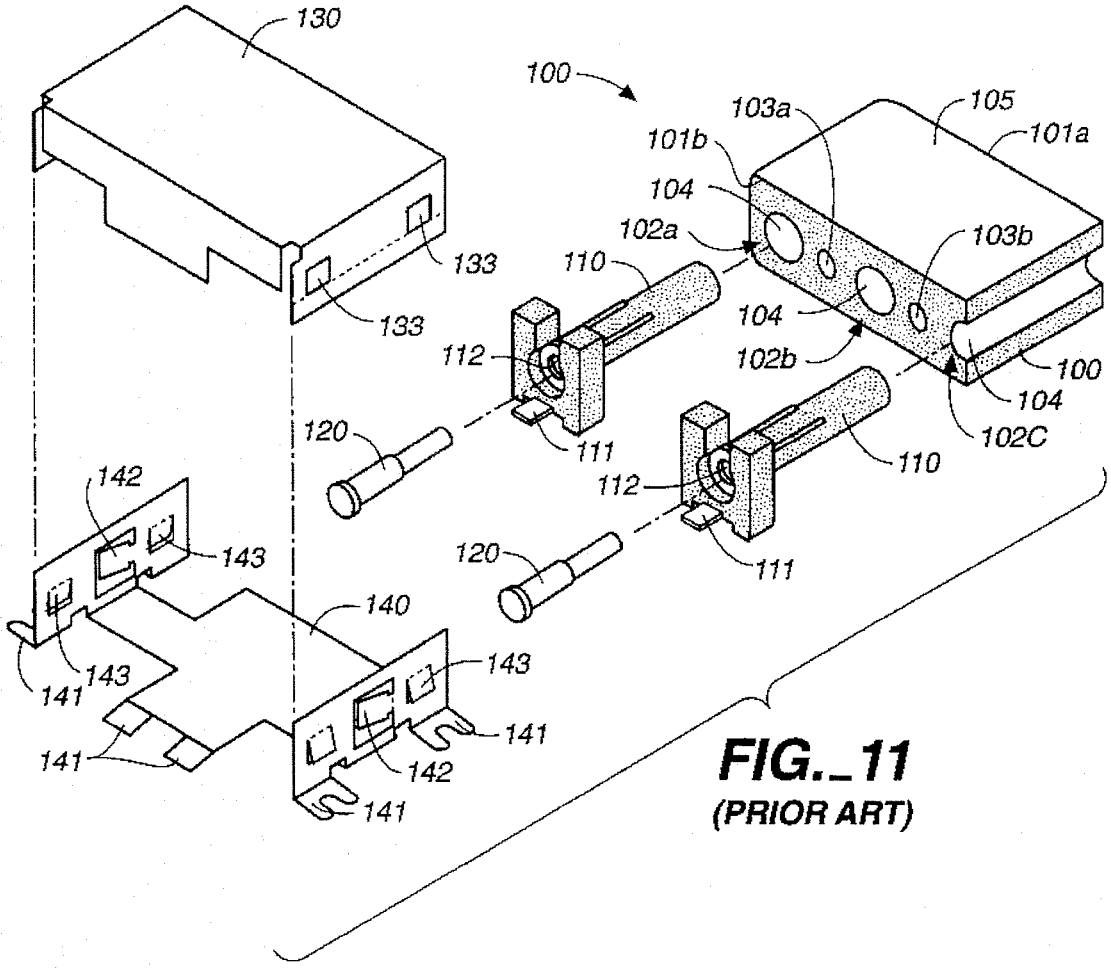
FIG. 11 (PRIOR ART)
FIG. 11 is an exploded diagonal view of the prior art apparatus of FIG. 10 with a portion of its dielectric block removed.
Figure 12:
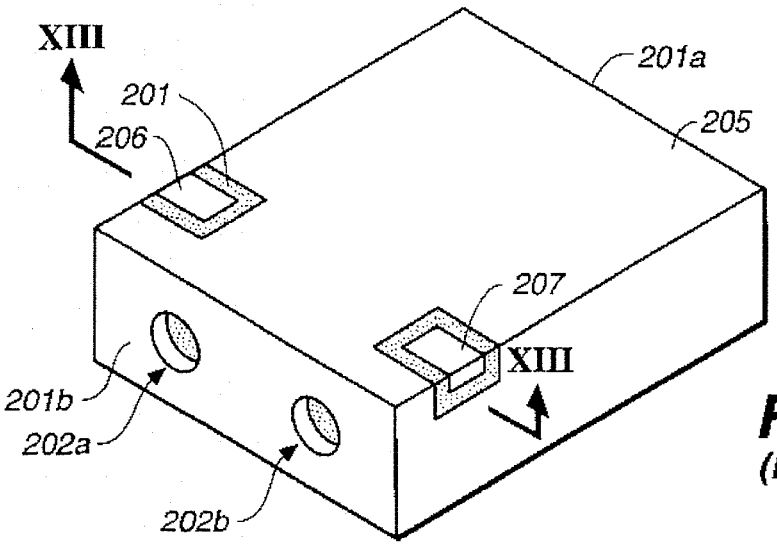
FIG. 12 (PRIOR ART)
FIG. 12 is an external view of another prior art dielectric resonator apparatus.
Figure 13:
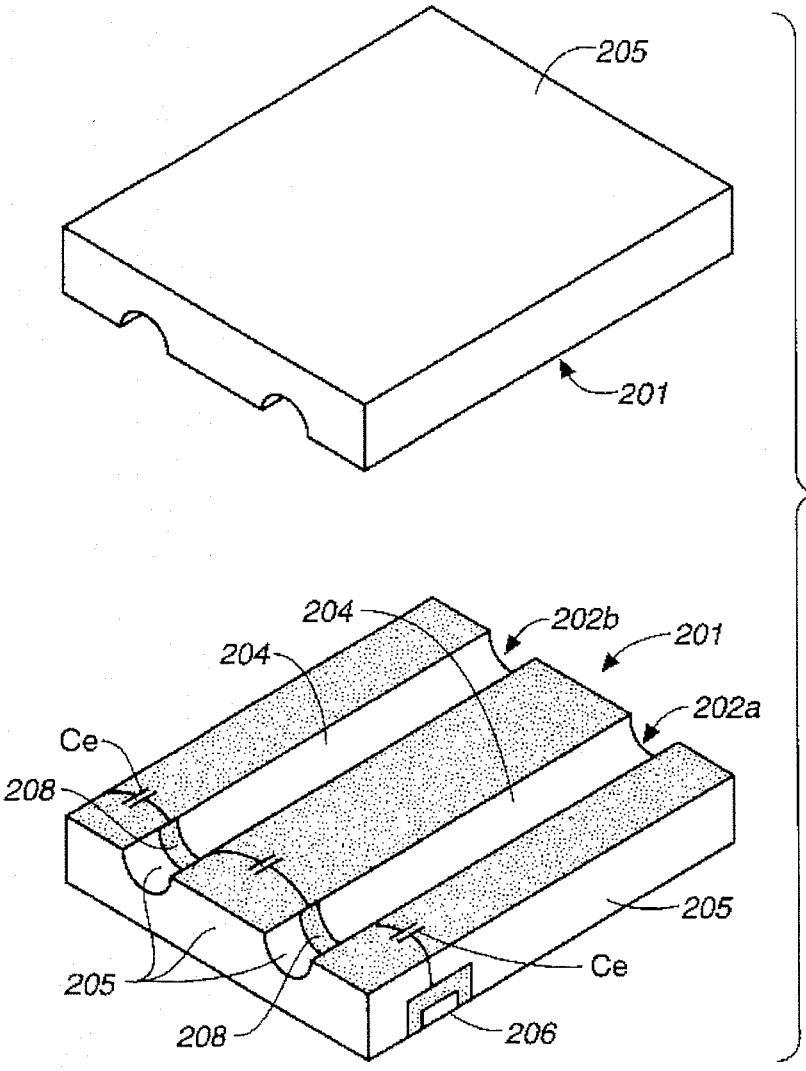
FIG. 13 (PRIOR ART)
FIG. 13 is an exploded diagonal view of the prior art apparatus of FIG. 12, cut and separated along plane shown by XIII—XIII therein, with a portion removed.

As can be seen in FIG. 3, the dielectric block 1A is nearly entirely covered by the outer conductor 15 except over the annular insulating section 18. It is to be noted that the second end surface 11*b*, too, is covered by the outer conductor 15. Thus, the electromagnetic field generated on the second end surface 11*b* is prevented from leaking out, and it is not necessary to provide metallic casing members of the kind shown at 130 and 140 in FIGS. 10 and 11 in the case of a prior art apparatus. As a result, the length, width and height of the apparatus can be made smaller, the number of parts and the cost are reduced, and surface-mounting becomes easier. The dielectric block 1A can be formed, for example, by first forming the resonator-forming throughholes 12*a* and 12*b*, then coating the insulating section 18 with a resin which cannot be applied by plating, and forming a copper film by plating over all surfaces of the block 1A. The-outer conductor 15 may be soldered to a grounding terminal of a circuit board (not shown) on which a desired circuit has been formed.

If the outer conductor 15 is formed by silver plating, some of the silver may diffuse into the Solder and the outer conductor 15 may become thinner and weaker. If this happens, there is an increased danger that the block 1A may drop off the circuit board due, for example, to vibrations. If the outer conductor 15 is made of copper, there is no danger of this kind.

The molded resin member 2A has two tubular parts 2*a* with diameter nearly equal to that of the resonator-forming throughholes 12*a* and 12*b* and a hinge part 2*z* and is formed by molding a dielectric resin material such as heat-resistant liquid crystal polymers with dielectric constant $\epsilon_r$ about equal to 2–3, polyester with high melting point, or TPX (registered trademark) with good high-frequency characteristics. Two input/output terminals 21*a* and 21*b* are insert-molded to the hinge part 2*z*, corresponding individually to the two tubular parts 2*a*. As shown in FIG. 3, these input/output terminals 21*a* and 21*b* are bent into a J-shape so as not to protrude outward too much and to make it easier to surface-mount the apparatus on a circuit board. The tubular parts 2*a* of the molded resin member 2A are each formed with a pin-accepting hole 22*a* or 22*b* with diameter approximately equal to that of the metallic pins 3 for accepting them therein. The molded resin member 2A is set inside the dielectric block 1A as its tubular parts 2*a* are inserted into the resonator-forming throughholes 12*a* and 12*b*. Since the tubular parts 2*a* and the resonator-forming throughholes 12*a* and 12*b* are about the same in diameter and there is not one but two tubular parts 2*a*, the molded resin member 2A is prevented from dropping off the dielectric block 1A or turning around on the dielectric block 1A although it is not made to adhere to the dielectric block 1A. The input/output terminals 21*a* and 21*b* are soldered to an input/output terminal of a circuit board. The length and diameter of the metallic pins 3 are selected such that external coupling capacitance $C_e$ of an appropriate level can be obtained, and these pins 3 are inserted into the pin-accepting holes 22*a* and 22*b* so as to be connected to the input/output terminals 21*a* and 21*b* and to form the external coupling capacitance $C_e$ formed with the internal conductor 14.

The dielectric resonator apparatus structured as shown in FIGS. 1, 2 and 3 contains within a single dielectric block 1A two coaxial dielectric resonators which are capacitively coupled through the two insulating section 18, and the coaxial dielectric resonators are individually connected to the input/output terminals 21*a* and 21*b* through the external coupling capacitance $C_e$ and the metallic pins 3. This is how the dielectric resonator apparatus functions as a two-stage bandpass filter and the external coupling capacitance $C_e$ can be adjusted by changing the distance by which the metallic pins 3 are inserted into the pin-accepting holes 22*a* and 22*b*. In other words, the dielectric resonator apparatus according to this invention does not have to be redesigned by changing the areas and arrangements of the input/output terminals, etc. each time the external coupling capacitance $C_e$ must be changed.

Figure 4:
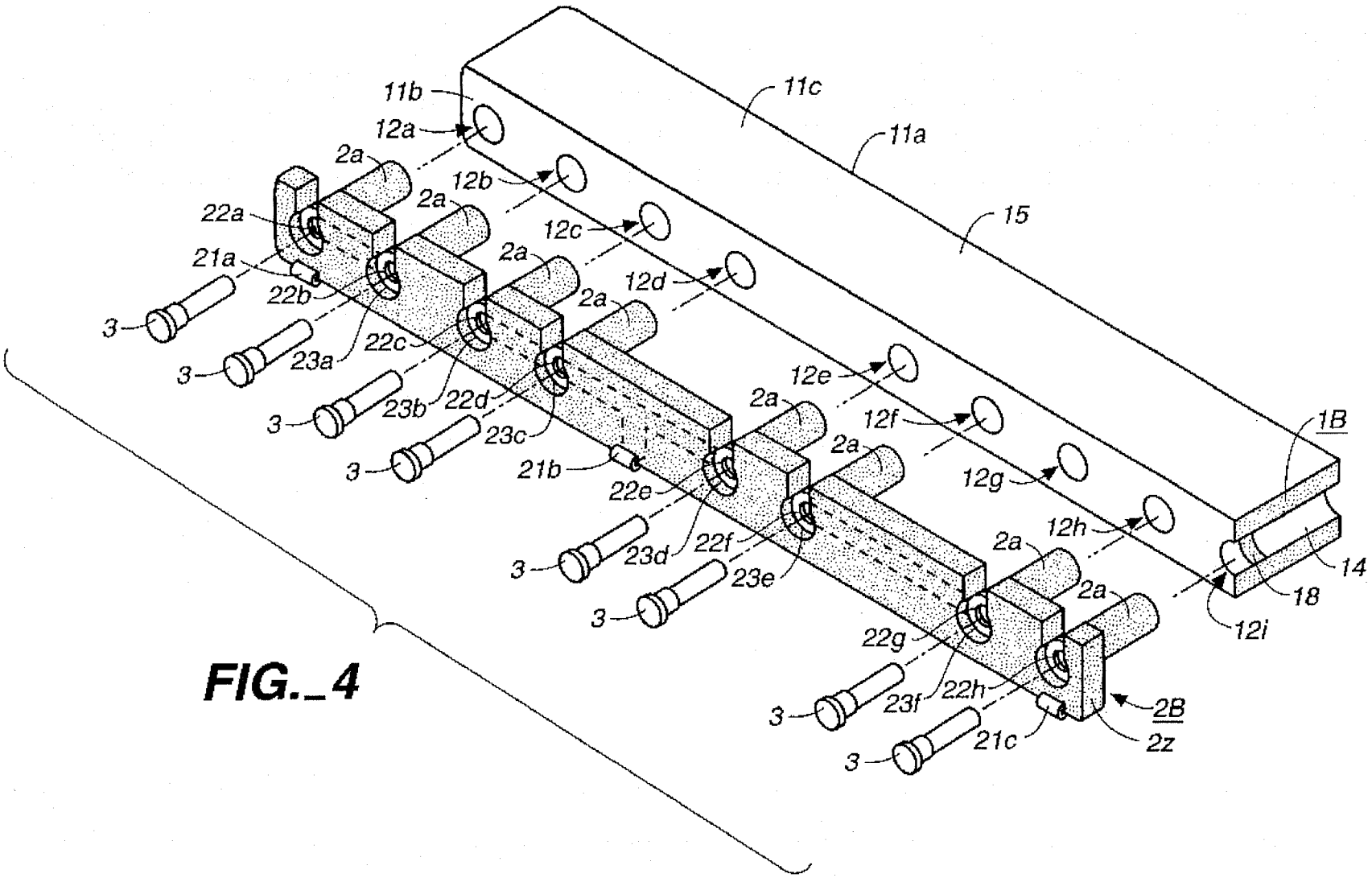
FIG. 4 is a partially exploded diagonal view of another dielectric resonator apparatus according to a second embodiment of the invention with a portion removed.

FIG. 4 shows another dielectric resonator apparatus according to a second embodiment of the invention adapted to function as a duplexer, for example, for making a single antenna (say, of a car telephone) both for transmission and reception. To this end, its dielectric block 1B is provided with a total of nine resonator-forming throughholes 12*a*–12*i*, of which four (12*a*–112*d*) are for transmission and five (12*e*–12*i*) are for reception. Inner conductors 14, insulating sections 18 and an outer conductor 15 are formed for these throughholes 12*a*–12*i* as explained above with reference to FIGS. 1–3. The four coaxial dielectric resonators 12*a*–12*d* for reception are respectively coupled capacitively across their insulating sections 18. Similarly, the five coaxial dielectric resonators 12*e*–12*i* are respectively coupled capacitively across their insulating sections 18.

The molded resin member 2B is produced by insert-molding and is composed of a hinge part 2Z and eight tubular parts 2*a* corresponding to the resonator-forming throughholes 12*a*–12*f*, 12*h* and 12*i* and having diameters about the same as those of these throughholes (12*a*–12*f*, 12*h* and 12*i*). Three input/output terminals 21*a*, 21*b* and 21*c* and connector terminals 23*a*–23*f* are insert-molded to the hinge part 2*z*. Input/output terminal 21*a* and connector terminal 23*a* are conductively connected; input/output terminal 21*b* is conductively connected to connector terminals 23*b*–23*d*; and connector terminals 23*e* and 23*f* are conductively connected. Pin-accepting holes 22*a*–22*h* of about the same diameter as that of metallic pins 3 are formed in input/output terminals 21*a* and 21*c* and connector terminals 23*a*–23*f*, and the pins 3 are individually inserted into these pin-accepting holes 22*a*–22*h*. Input/output terminal 21*a* is used as a transmission terminal and is connected to a transmission terminal on a circuit board. Input/output terminal 21*b* is used as an antenna terminal and is connected to an antenna terminal on a circuit board. Input/output terminal 21*c* is used as a reception terminal and is connected to a reception terminal on a circuit board. In summary, the dielectric resonator apparatus of FIG. 4 has nine dielectric coaxial resonators inside a single dielectric block 1B, the four of these dielectric coaxial resonators on the transmission side being capacitively coupled across four insulating sections 18 and the five of these dielectric coaxial resonators on the reception side being capacitively coupled across five insulating sections 18. It is to be noted that connector terminals 23*a* and 23*b* are not connected, that connector terminals 23*d* and 23*e* are not connected, and that connector terminal 23*f* and input/output terminal 21*c* are not connected, such that signals with a specified frequency can be attenuated both on the transmission and reception sides. Thus, signals transmitted from the transmission side to the antenna can be prevented from reaching the reception side, signals transmitted from the antenna to the reception side can be prevented from reaching the transmission side, and the apparatus of FIG. 4 can function as a duplexer with respect to the input/output terminals 21*a*, 21*b* and 21*c*. Accordingly, apparatus thus structured have similar advantageous effects as the apparatus shown in FIGS. 1–3.

Figure 5:
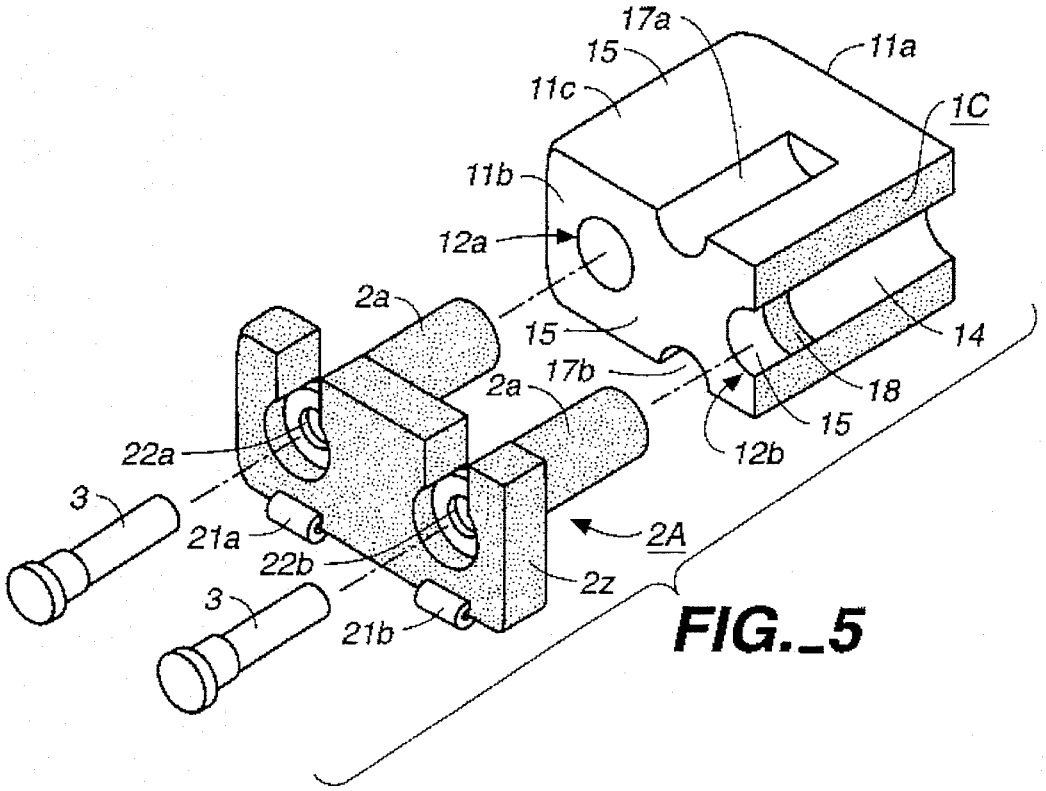
FIG. 5 is a partially exploded diagonal view of still another dielectric resonator apparatus according to a third embodiment of the invention with a portion removed.

FIG. 5 shows another dielectric resonator apparatus according to a third embodiment of the invention also adapted to function as a two-stage bandpass filter using a molded resin member 2A and metallic pins 3, like the one shown in FIGS. 1–3. What is noteworthy with the apparatus of FIG. 5 is that cross-sectionally semi-circular grooves 17*a* and 17*b* are formed on the dielectric block 1C in order to make the characteristic impedance on the side of the first end surface 11*a* different from that on the side of the second end surface 11*b*. Groove 17*a* is on the upper surface and groove 18*b* is on the lower surface. They are both formed parallel to and between the two resonator-forming throughholes 12*a* and 12*b*, starting from the second end surface 11*b* of the dielectric block 1C and extending only to a point approximately halfway between the two end surfaces 11*a* and 11*b*. The inside surfaces of the grooves 17*a* and 17*b* are covered with the outer conductor 15. In other respects, the dielectric block 1C is structured similarly to the block 1A described above.

The two coaxial dielectric resonators thus formed inside the single dielectric block 1C are inductively coupled to each other through the grooves 17*a* and 17*b*, having a wider passband. Since the level of this inductive coupling can be adjusted by varying the lengths, widths, depths, positions, cross-sectional shapes, etc. of the grooves 17*a* and 17*b*, this dielectric resonator apparatus can function as a two-stage bandpass filter between the input/output terminals 21*a* and 21*b*. Accordingly, apparatus thus structured have similar advantageous effects as those shown above in FIGS. 1–4.

Figure 6:
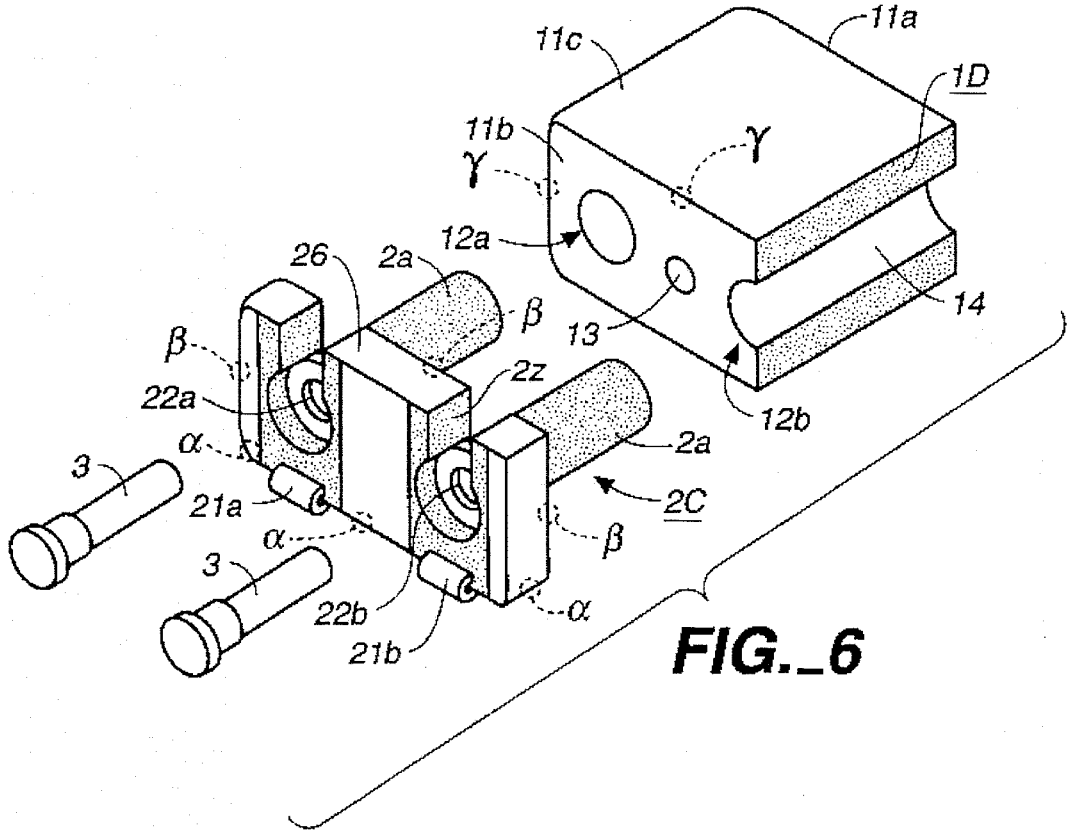
FIG. 6 is a partially exploded diagonal view of still another dielectric resonator apparatus according to a fourth embodiment of the invention with a portion removed.

FIG. 6 shows still another dielectric resonator apparatus according to a fourth embodiment of the invention, also adapted to function as a two-stage bandpass filter like those shown above in FIGS. 1–3 and 5. One of the differences to be noted in FIG. 6 is that there is a conductive film 26 formed on outside surfaces of the hinge part 2*z* of its molded resin member 2C, serving as shielding means for preventing electromagnetic waves from leaking outside through the second end surface 11*b* of its dielectric block 1D. Such a molded resin member can be produced, for example, by first forming the hinge part 2*z* and its tubular parts 2*a* from an un-platable dielectric resin material, covering specified areas of the hinge part 2*z* with a platable dielectric resin material and then forming a film all over the molded resin member 2C by copper plating.

Another characteristic to be noted, regarding the dielectric resonator apparatus of FIG. 6, is that the outer conductor 15 is not formed on the second end surface 11*b* of the dielectric block 1D or inside the resonator-forming throughholes 12*a* and 12*b* because electromagnetic waves are prevented from leaking out by the conductive film 26 as described above. In other words, there are no insulating section 18 formed inside the throughholes 12*a* and 12*b*. Instead, the inner conductors 14 are formed inside the throughholes 12*a* and 12*b* entirely from the first end surface 11*a* to the second end surface 11*b*. In order to couple together the coaxial resonators formed inside the throughholes 12*a* and 12*b*, a coupling throughhole 13 is provided through the dielectric block 1D, opening both to its first and second end surfaces 11*a* and 11*b*.

The dielectric resonator apparatus thus formed has two dielectric coaxial resonators inside the single dielectric block 1D, and these two dielectric coaxial resonators are magnetically coupled through the coupling throughhole 13. The level of this coupling can be adjusted by varying the diameter, length, position, etc. of the coupling throughhole 13, and the dielectric resonator apparatus can serve as a two-stage bandpass filter between its input/output terminals 21*a* and 21*b*. Accordingly, apparatus thus structured also have similar advantageous effects as those shown above in FIGS. 1–5.

It is to be noted that the conductive film 26 on the molded resin member 2C must be in an equipotential relationship with the outer conductor 15 on the dielectric block 1D. This may be accomplished by soldering, for example, the part marked by letter α on the conductive film 26 with a grounding terminal on a circuit board. As another example, the part marked by letter β on the conductive film 26 and the part marked γ on the dielectric block 1D may be directly soldered together.

Figure 7:
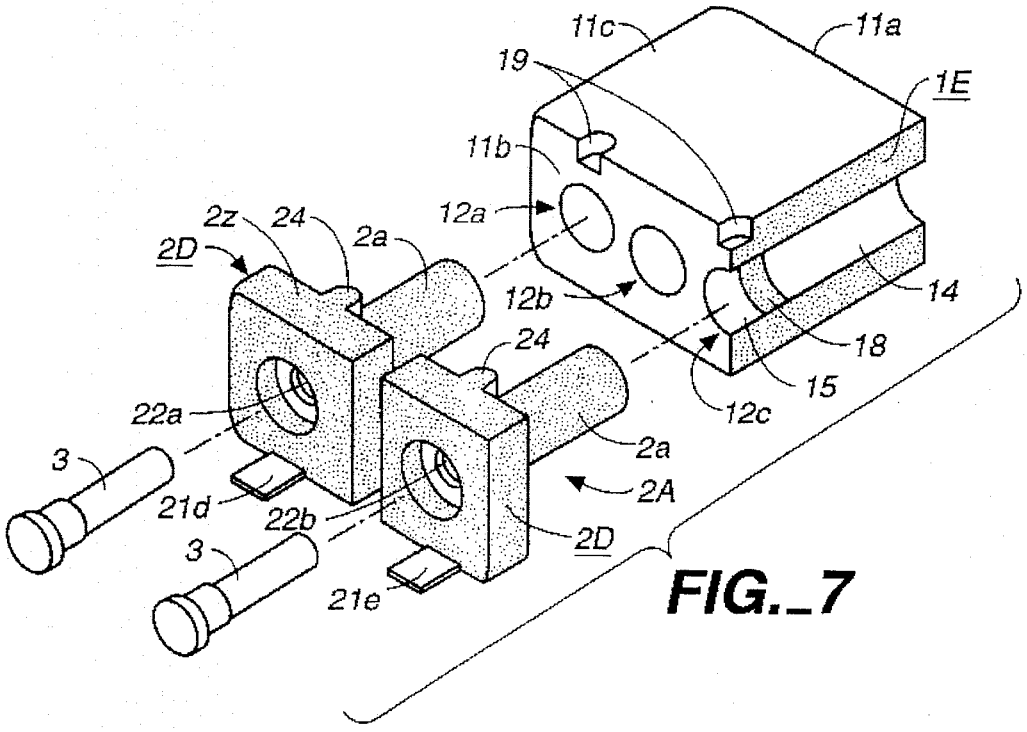
FIG. 7 is a partially exploded diagonal view of still another dielectric resonator apparatus according to a fifth embodiment of the invention with a portion removed.

FIG. 7 shows still another dielectric resonator apparatus according to a fifth embodiment of the invention, adapted to function as a three-stage bandpass filter. For this purpose, its dielectricsblock 1E is formed with three resonator-forming throughholes 12*a*, 12*b* and 12*c*, each provided therein with an inner conductor 14, an insulating section 18 and an outer conductor 15. One of the noteworthy aspects of this embodiment is that there are two separate molded resin members 2D. Two input/output terminals 21*d* and 21*e*, bent in an L-shape, are each insert-molded into the hinge part 2*z* of these molded resin members 2D. In order to prevent the molded resin members 2D from rotating on the dielectric block 1E, each hinge part 2*z* is provided with a protrusion 24 for engaging with an indentation 19 correspondingly formed on the dielectric block 1E. In summary, the dielectric resonator apparatus of FIG. 7 is provided with three coaxial dielectric resonators inside a single dielectric block 1E. These three coaxial resonators are coupled capacitively across the insulating sections 18, and the apparatus functions as a three-stage bandpass filter between the input/output terminals 21*d* and 21*e*. Accordingly, apparatus thus structured also have similar advantageous effects as those shown above in FIGS. 1–6.

Figure 8:
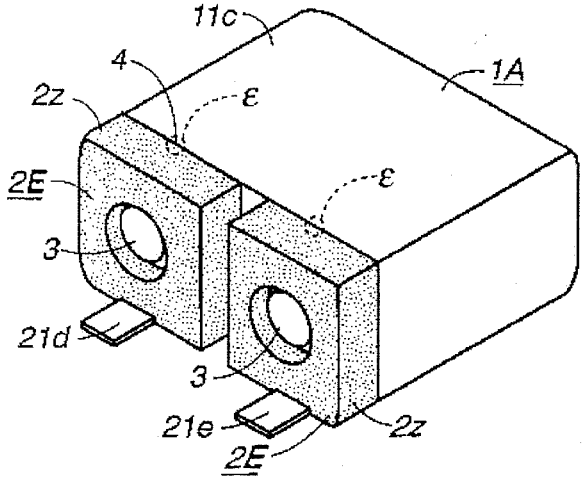
FIG. 8 is an external view of still another dielectric resonator apparatus according to a sixth embodiment of the invention.

FIG. 8 shows still another dielectric resonator apparatus according to a sixth embodiment of the invention, adapted to function as a two-stage bandpass filter, using a dielectric block 1A as described above. It has two mutually separated molded resin members 2E, like the embodiment described above with reference to FIG. 7. The hinge parts 2*z* of the molded resin members 2E are not provided with any protrusions for engagement, and the corresponding dielectric block 1A is not formed with any indentations. In order to prevent the molded resin members 2E from rotating on the dielectric block 1A, an adhesive material 4 is applied at positions indicated by letter ϵ between the hinge sections 2*z* and the dielectric block 1A. In summary, the dielectric resonator apparatus of FIG. 8 is provided with two coaxial resonators inside a single dielectric block 1A and capacitively coupled with each other across the insulating sections 18, and the apparatus functions as a two-stage bandpass filter between the input/output terminals 21*d* and 21*e*. Accordingly, apparatus thus structured also have similar advantageous effects as those shown above in FIGS. 1–7.

Figure 9:
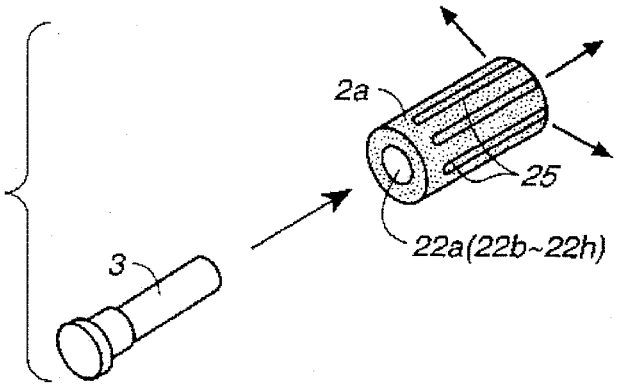
FIG. 9 is an external view of a tubular part according to a seventh embodiment of the invention.

The present invention has been described above with reference to a limited number of examples, but they are not intended to limit the scope of the invention. Many modifications and variations thereon are intended to be included. For example, the tubular parts 2*a* may be formed with slits 25, as shown in FIG. 9, such that they can expand radially when the metallic pins 3 are inserted into their pin-accepting holes 22*a*, etc., and that the molded resin members and the dielectric block are contacted more securely to each other, preventing the former from rotating on or sliding off the latter. Such slits 25 may be formed on the tubular parts 2*a* of any of the molded resin members 2A–2E shown above in FIGS. 1–8.

Although the present invention has been explained above as applied to two-stage and three-stage bandpass filters, it can be applied to bandpass filters with four or more stages, and also to any multi-stage band elimination filters. Although insert-molding of J-shaped and L-shaped input/output terminals 21*a*–21*e* has been described, input/output terminals of different shapes may be insert-molded.. Input/output terminals may be formed on the molded resin member 2A–2E by depositing a solder material. Although shielding of electromagnetic waves was effected according to the embodiments described above either by forming an outer conductor on the second end surface or by forming a conductive film on the hinge part, it may be accomplished by both means, as well. It now goes without saying that there are many advantages to be gained by the present invention. By forming shielding means on the second end surface of the dielectric block or on the molded resin member, upper and lower metallic casing members of prior art apparatus become unnecessary. As a result, the overall size of the apparatus, as well as the total number of constituent parts, can be reduced, surface-molding becomes easier, and the apparatus can be constructed less expensively. Since connections to input/output terminals are accomplished by inserting metallic pins into pin-accepting holes and external-connection capacitance is thereby formed with the inner conductor, the capacitance can be adjusted by varying the distance by which the metallic pins are inserted. In other words, it is no longer necessary according to the present invention to redesign the areas or positions of the input-output terminals in order to adjust capacitance.

What is claimed is:

1. A dielectric resonator apparatus containing coaxial resonators; said apparatus comprising:

a dielectric block made of a dielectric material, having a first end surface, a second end surface and a plurality of side surfaces between said first and second end surfaces, said block being formed with resonator-forming throughholes penetrating therethrough and having openings on said first and second end surfaces;

inner conductors inside said resonator-forming throughholes, annular insulating sections being provided inside said throughholes to prevent said inner conductors from reaching said second surface;

an outer conductor at least on said side surfaces and said first end surface;

a molded resin member made of a dielectric resin material, having pin-accepting holes therethrough and being attached to said resonator-forming throughholes;

input/output terminals formed on said molded resin member and insulated from said inner conductors and said outer conductor;

metallic pins adapted to be inserted into said pin-accepting holes to thereby contact said input-output terminals and to provide external-connection capacitance with said inner conductors; and a conductive shielding film formed on said second end surface, said conductive shielding film preventing electromagnetic waves from leaking outside.

2. A method of adjusting functional characteristics of a dielectric resonator apparatus containing coaxial resonators and comprising:

a dielectric block made of a dielectric material, having a first end surface, a second end surface and a plurality of side surfaces between said first and second end surfaces, said block being formed with resonator-forming throughholes penetrating therethrough and having openings on said first and second end surfaces;

inner conductors inside said resonator-forming throughholes, annular insulating sections being provided inside said throughholes to prevent said inner conductors from reaching said second surface;

an outer conductor at least on said side surfaces and said first end surface;

a molded resin member made of a dielectric resin material, having pin-accepting holes therethrough and being attached to said resonator-forming throughholes;

input/output terminals formed on said molded resin member and insulated from said inner conductors and said outer conductor;

metallic pins adapted to inserted into said pin-accepting holes to thereby contact said input-output terminals and to provide external-connection capacitance with said inner conductors; and a conductive shielding film formed on said second end surface, said conductive shielding film preventing electromagnetic waves from leaking outside;

said method comprising the step of controlling said external-connection capacitance by varying the distance by which said metallic pins are inserted into said pin-accepting holes.

3. A dielectric resonator apparatus containing coaxial resonators; said apparatus comprising:

a dielectric block made of a dielectric material, having a first end surface, a second surface and a plurality of side surfaces between said first and second end surfaces, said block being formed with resonator-forming throughholes penetrating therethrough and having openings on said first and second end surfaces;

inner conductors inside said resonator-forming throughholes;

an outer conductor at least on said side surfaces and said first end surface;

a molded resin member made of a dielectric resin material having pin-accepting holes therethrough and being attached to said resonator-forming throughholes; input/output terminals formed on said molded resin member and insulated from said inner conductors and said outer conductor;

metallic pins adapted to be inserted into said pin-accepting holes to thereby contact said input-output terminals and to provide external-connection capacitance with said inner conductors; and a conductive shielding film formed on said molded resin member, said conductive shielding film preventing electromagnetic waves from leaking outside.

4. The dielectric resonator apparatus of claim 3 wherein said dielectric block has resonator coupling means formed therethrough for coupling resonators formed by said inner conductors.

5. A method of adjusting functional characteristics of a dielectric resonator apparatus containing coaxial resonators and comprising:

dielectric block made of a dielectric material, having a first end surface, a second end surface and a plurality of side surfaces between said first and second end surfaces, said block being formed with resonator-forming throughholes penetrating therethrough and having openings on said first and second end surfaces;

inner conductors inside said resonator-forming throughholes;

an outer conductor at least on said side surfaces and said first end surface;

a molded resin member made of a dielectric resin material, having pin-accepting holes therethrough and being attached to said resonator-forming throughholes;

input/output terminals formed on said molded resin member and insulated from said inner conductors and said outer conductor;

metallic pins adapted to be inserted into said pin-accepting holes to thereby contact said input-output terminals and to provide external-connection capacitance with said inner conductors; and a conductive shielding film formed on said molded resin member, said conductive shielding film preventing electromagnetic waves from leaking outside:

said method comprising the step of controlling said external-connection capacitance by varying the distance by which said metallic pins are inserted into said pin-accepting holes.

* * * * *